United States Patent [19]

Lacher, Jr.

[11] 4,155,230

[45] May 22, 1979

[54] PAINT ROLLER CLEANER

[76] Inventor: Morgan D. Lacher, Jr., 541 Willowbrook Dr., Gretna, La. 70053

[21] Appl. No.: 880,198

[22] Filed: Feb. 22, 1978

[51] Int. Cl.[2] ..... B08B 3/04; D06F 5/00

[52] U.S. Cl. ..... 68/213; 134/117

[58] Field of Search ..... 68/213; 8/149; 15/38; 134/117, 137, 138, 149; 210/449, 460

[56] References Cited

U.S. PATENT DOCUMENTS

| | | | |
|---|---|---|---|
| 276,179 | 4/1883 | Haynes | 210/449 |
| 316,457 | 4/1885 | Haynes | 210/449 |
| 2,831,488 | 4/1958 | Anderson | 134/138 |
| 3,421,527 | 1/1969 | Dettman | 134/149 X |
| 3,431,574 | 3/1969 | Mathieu | 68/213 X |
| 4,061,153 | 12/1977 | Doherty | 134/149 X |

FOREIGN PATENT DOCUMENTS

| | | | |
|---|---|---|---|
| 793180 | 4/1958 | United Kingdom | 15/104.92 |

*Primary Examiner*—Daniel Blum

*Attorney, Agent, or Firm*—Bacon & Thomas

[57] ABSTRACT

A hollow cylindrical paint roller cover of absorbent material fits snugly in a cylindrical casing. The hollow center of the cover is closed by appropriate plugs and a cleaning fluid is forced into one end of the casing to flow axially through only the absorbent material and out the other end of the casing. The device is adapted to clean a roller cover having a rigid inner shell or one having no supporting shell and may be made with flexible walls to permit removing the cover from its roller without getting paint on one's hands.

4 Claims, 6 Drawing Figures

PAINT ROLLER CLEANER

BACKGROUND OF THE INVENTION

This invention is in the field of cleaning apparatus, particularly for cleaning fabric covers for paint rollers.

Customarily paint rollers are provided with a more or less rigid cylindrical frame mounted for rotation on a suitable handle and which frame is covered by a removable paint applicator cover of fabric or other absorbent material. Upon completion of a paint job, it is necessary to clean the cover so it may be used again. Several proposals have been made for devices for cleaning such covers but in general they propose to place the cover loosely in a closed container and flow water or other paint solvent over the entire inner and outer surface of the cover rather than enforcing flow through only the material of the cover itself.

SUMMARY OF THE INVENTION

The present invention contemplates a container for paint roller covers and means for enforcing flow of cleaning solvent axially along and through the material of the cover while preventing flow of such liquid through the hollow core or center of the cover member.

DESCRIPTION OF THE PREFERRED EMBODIMENTS

Figures 1, 2, 3, 4, 5, 6:
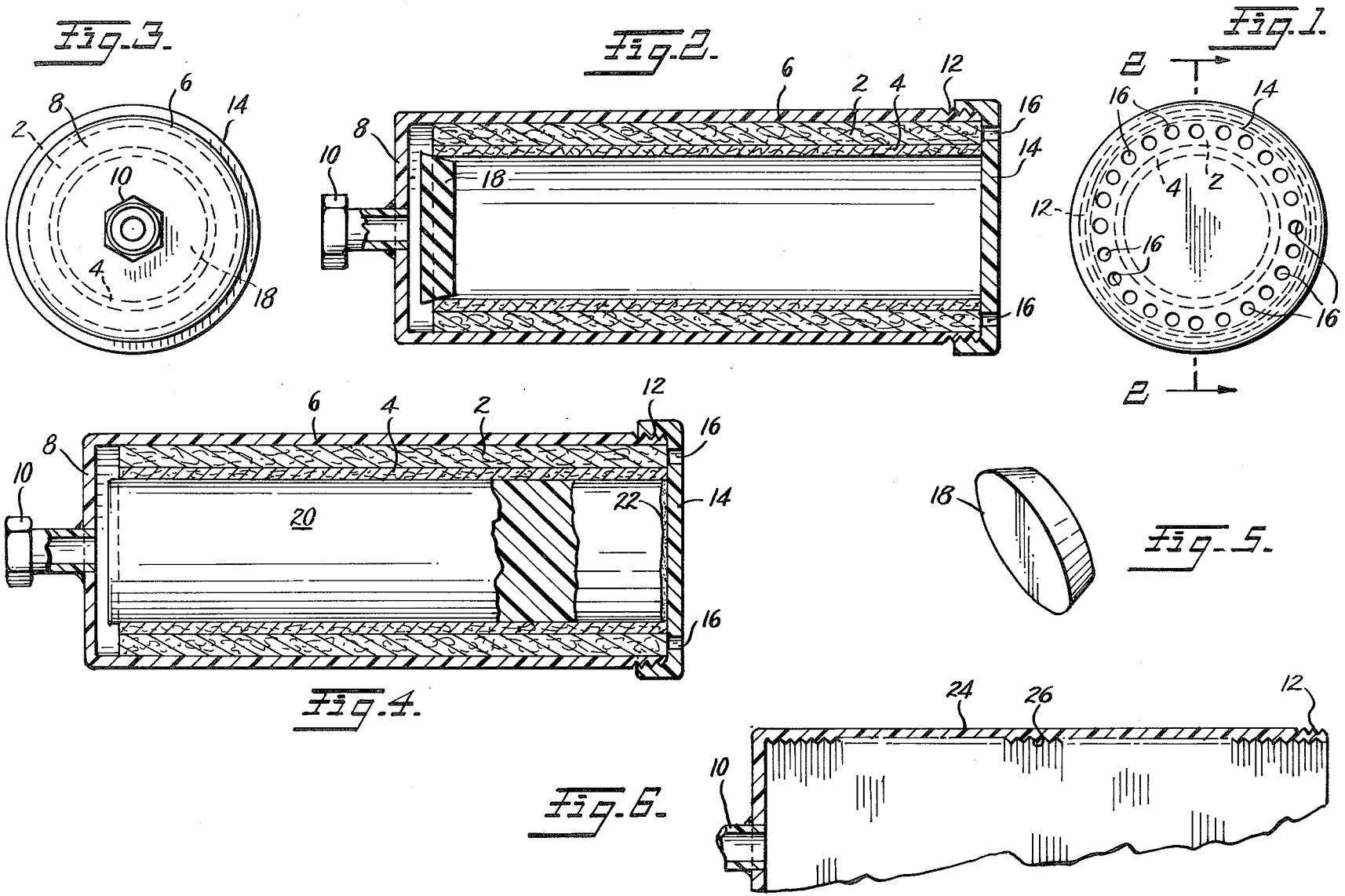
FIG. 1 is an end view of one embodiment of the present invention.
FIG. 2 is a longitudinal sectional view taken on the line 2—2 of FIG. 1.
FIG. 3 is an end view of this embodiment as seen from the left side of FIG. 2.
FIG. 4 is a longitudinal sectional view through a further embodiment of the invention.
FIG. 5 is a perspective view of a plug member for use with the embodiment of FIGS. 1-3.
FIG. 6 is a fragmentary longitudinal sectional view through a further embodiment of the invention.

Referring first to FIG. 2, numeral 2 designates the fabric or other absorbent material cover for a paint roller and numeral 4 designates a more or less rigid liner for such cover. It is quite customary to provide paint roller covers with a more or less rigid liner such as that depicted at 4. A cylindrical container 6 is of an inner diameter substantially equal to the outer diameter of the roller cover 2 and in which that roller cover is snugly received. At one end the container 6 is closed by an end wall 8 having fitting 10 thereon to be connected to a pressurized source of paint solvent, such as water. The opposite end of the container 6 is open but is provided wih external screw threads 12 to threadedly receive a cap member 14. The cap member 14 is provided with a circular series of openings 16 axially aligned with the annular space occupied by the porous roller cover portion 2. As shown in FIG. 2, a roller cover to be cleaned is within the container 6 and the cover 14 has been applied. A tapered end plug 18 is placed in one end of the inner shell 4 before the roller cover is inserted in the container. With the parts in the position illustrated, it is apparent that introduction of pressurized paint solvent through fitting 10 will cause flow thereof axially through only the portion 2 of the roller cover to thoroughly clean the same and the spent solvent exits through the openings 16. The plug 18 prevents solvent from flowing into the hollow center of the roller which is held against cover 14 by the pressure of the entering solvent.

In some instances paint rollers may not be provided with a rigid inner shell or it may be inconvenient to provide the plug 18. The modification of FIG. 4 provides for cleaning such paint rollers and even though a substantially rigid shell 4 is shown in the drawings, this form of the invention is applicable equally to flexible roller covers without such an inner shell. The container or casing 6 is identical to the container described with reference to FIG. 2. Also, the cover 14 may be identical to that of FIG. 2 but in addition the cover 14 is provided with a solid cylindrical plug member 20 preferably adhered to the inner surface of the cover 14 by a suitable adhesive 22. It will be obvious that preparation for cleaning the roller cover is made by first slipping the cover over the plug 20, which plug completely occupies and closes the hollow interior of the roller cover. The assembly is then inserted through the open end of housing 6 and the cover screwed in place to the position shown in FIG. 4 after which the pressurized solvent is directed into the apparatus to clean the roller cover, as already described.

In some instances roller covers may be quite tightly fitted on the roller frame and difficult to remove therefrom without manually handling the paint-soaked cover. It may not be desirable to handle the paint-soaked cover in which case the modification of FIG. 6 may be employed. The modification of FIG. 6 may employ either the plug 18 of FIG. 2 or the plug 20 of FIG. 4. The only difference being in the difference in the characteristics of the casing 24. In this instance, the casing 24 is provided with a cylindrical side wall which is quite flexible and wherein its inner surface is roughened such as at 26. With this modification, the roller with its cover attached may be manipulated to insert the roller portion into the container or casing 24 and the latter may be manually gripped and squeezed to flex inwardly. By virtue of the roughened interior surface 26, squeezing of the casing 24 in the manner described will cause the casing to firmly grip the roller cover and hold the same in the casing while the roller frame itself is withdrawn. Thus, the roller cover may be positioned in the casing without manually handling the same.

While a limited number of specific embodiments of the invention are shown and described herein, the same are merely illustrative of the principles of the invention and other forms may be employed within the scope of the appended claims.

I claim:

1. In combination, cleaning apparatus and a hollow cylindrical paint roller cover of absorbent material;

said cleaning apparatus comprising a generally cylindrical casing, open at one end, of an inner diameter substantially equal to the outer diameter of said paint roller cover, said paint roller cover being in said casing in contact with the wall thereof;

a removable closure for said open end, provided with discharge openings communicating with the interior of said casing adjacent the inner periphery thereof;

inlet means at the other end of said casing for admitting cleaning fluid; and plug means closing at least the end of said paint roller cover adjacent said other end for preventing flow of cleaning fluid through the hollow center of said roller cover thereby permitting flow of cleaning fluid from said inlet to said discharge openings only axially along the inner peripheral region of said casing and the absorbent material of said cover.

2. Cleaning apparatus as defined in claim 1 wherein said roller cover is provided with a substantially rigid hollow inner shell adapted to abut, at one end, with the inner surface of said closure inwardly of said discharge openings; said plug means comprising a plug member adapted to close the other end of said shell.

3. Cleaning apparatus for a hollow cylindrical paint roller cover of absorbent material comprising:

a generally cylindrical casing, open at one end, of an inner diameter substantially equal to the outer diameter of a paint roller cover to be cleaned;

a removable closure for said open end, provided with discharge openings communicating with the interior of said casing adjacent the inner periphery thereof;

inlet means at the other end of said casing for admitting cleaning fluid;

plug means for preventing flow of cleaning fluid through the hollow center of a roller cover in said casing thereby permitting flow of cleaning fluid from said inlet to said discharge openings only axially along the inner periphery region of said casing;

said plug means comprising a cylindrical plug carried by said closure and extending into said casing, said cylindrical plug being of a size and shape to fill the inside of a roller cover to be cleaned.

4. Cleaning apparatus for a hollow cylindrical paint roller cover of absorbent material comprising:

a generally cylindrical casing, open at one end, of an inner diameter substantially equal to the outer diameter of a paint roller cover to be cleaned;

a removable closure for said open end, provided with discharge openings communicating with the interior of said casing adjacent the inner periphery thereof;

inlet means at the other end of said casing for admitting cleaning fluid;

plug means for preventing flow of cleaning fluid through the hollow center of a roller cover in said casing thereby permitting flow of cleaning fluid from said inlet to said discharge openings only axially along the inner periphery region of said casing;

said casing being provided with a resiliently flexible cylindrical side wall having a roughened inner surface.

* * * * *